US006786394B2

(12) United States Patent
Prince

(10) Patent No.: US 6,786,394 B2
(45) Date of Patent: Sep. 7, 2004

(54) UNITARY BULK CONTAINER FOR USE WITH INTERNAL BAG

(75) Inventor: Robert C. Prince, Gresham, OR (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/100,857

(22) Filed: Mar. 18, 2002

(65) Prior Publication Data

US 2002/0148885 A1 Oct. 17, 2002

Related U.S. Application Data

(60) Provisional application No. 60/283,386, filed on Apr. 11, 2001.

(51) Int. Cl.[7] ..... B65D 3/00

(52) U.S. Cl. ..... 229/117.3; 229/108; 229/117.28

(58) Field of Search ..... 229/105, 108, 229/109, 117.3, 122.23, 122.32, 117.28; 206/591

(56) References Cited

U.S. PATENT DOCUMENTS 2,714,981 A 8/1955 Leavens
2,808,193 A * 10/1957 Michalka ..... 206/591
3,240,417 A 3/1966 Andreini
3,275,216 A * 9/1966 Collins ..... 229/108
3,873,017 A * 3/1975 Blatt ..... 229/108
4,850,506 A * 7/1989 Heaps, Jr. et al. ..... 229/105 X
5,351,849 A * 10/1994 Jagenburg et al. ..... 229/117.3
5,437,388 A * 8/1995 Bartelt et al. ..... 229/122.23
5,474,203 A * 12/1995 Baker ..... 229/105 X
5,735,429 A * 4/1998 Whitworth ..... 229/122.21
5,772,108 A * 6/1998 Ruggiere, Sr. et al. ..... 229/109
5,988,491 A * 11/1999 Morrison ..... 229/122.32

* cited by examiner

*Primary Examiner*—Tri M. Mai
(74) *Attorney, Agent, or Firm*—Christensen O'Connor Johnson Kindness PLLC

(57) ABSTRACT

A unitary bulk container is described having an inner sleeve (10) and an outer sleeve (12). The inner sleeve (10) has opposed side panels (22), (24) and two sets of opposed end panels. The outer sleeve (12) has opposed side panels (62), (66) and opposed end panels (60), (64). As assembled, the inner sleeve (10) is positioned within the outer sleeve (12) with either the inner sleeve side or end panels being adhered to the outer sleeve side or end panels. The other of the inner and outer sleeve side or end panels are not adhered to one another. The outer sleeve (12) of the assembled container preferably has a four-sided shaped, though at least two of its upright corners do not form true 90 degree angles. The container is capable of assuming a flat unitary collapsed state and an open unitary erected state. The container is initially formed to its flat unitary collapsed state.

25 Claims, 18 Drawing Sheets

UNITARY BULK CONTAINER FOR USE WITH INTERNAL BAG

CROSS REFERENCE TO RELATED APPLICATIONS

This application is a United States Non-Provisional Patent Application based off of U.S. Provisional patent application No. 60/283,386 filed Apr. 11, 2001 and International Patent Application Number PCT/US01/40758 filed May 16, 2001.

FIELD OF THE INVENTION

The present invention relates to paperboard containers, and more particularly, to large bulk containers formed from a plurality of telescoped sleeves, such container preferably being for use with an internal bag holding fluid material such as a liquid or dry dispensable material.

BACKGROUND OF THE INVENTION

As background information, it is known to ship fluid material in a large rigid cylindrical drum (e.g., a large metal drum) or a large paperboard container having a sealed inner fluid bag. A significant problem with these packages is that neither fit efficiently on a standard shipping pallet, such as the Grocery Marketers Association (G.M.A.) 40 inch by 48 inch universal pallet or the European metric pallet.

In addition, current bulk paperboard packages are made of three or more box pieces (called "box blanks", or simply "blanks") of corrugated material. These pieces are either assembled by the paperboard manufacturer and then shipped to the customer for use, or the pieces are sent to the customer who must then assemble the blanks into useable bulk containers. Accepting a stock of large assembled containers (even though empty) is an undesirable arrangement for the customer since it requires significant storage space. Alternatively, the task of assembling corrugated containers is undesirable because it is typically difficult and time-consuming.

While drum type containers do not require assembly, they do require large volumes of space for shipment, handling, and storage (when full or empty.) A drum unit is not collapsible. In addition, drum units have no bottom discharge capability. To obtain the drum contents, the drum must be tilted 90 degrees or the contents pumped out of the drum top. Drum units also require costly cleaning and are difficult to dispose of when no longer useful. Thus, there are environmental issues in their disposal and accumulation.

Considering the above, a need exists for a bulk container particularly for use with fluid material. Ideally, such container would be sized to fit efficiently on standard-sized pallets, both for United States and European sizes. The container should be easy to assemble and require minimal amounts of storage space whether full or empty. In addition, such container should eliminate, or at least reduce, the need for metal drums.

SUMMARY OF THE INVENTION

In accordance with aspects of the present invention, a unitary bulk container is described having an inner sleeve and an outer sleeve. The inner sleeve has opposed side panels and two sets of opposed end panels. The outer sleeve also has opposed side panels and opposed end panels. As assembled, the inner sleeve is positioned within the outer sleeve. Either the inner sleeve side panels are adhered to the outer sleeve side panels or the inner sleeve end panels are adhered to the outer sleeve end panels. The other of the inner sleeve side or end panels are not adhered to the outer sleeve. This allows relative movement between the two unadhered opposed sides. The outer sleeve of the assembled container has a four-sided shaped (such as a square or rectangle), though, at least two of the outer sleeve upright corners do not form true 90 degree angles. The container is capable of assuming a flat unitary collapsed state and an open unitary erected state. The container is initially formed to its flat unitary collapsed state.

In accordance with other aspects of the invention, the non-90 degree corner angles of the outer sleeve are formed by using outer sleeve panels of various widths. For example, in one embodiment, one outer sleeve side panel is larger than the other outer sleeve side panel and one outer sleeve end panel is larger than the other outer sleeve end panel. Similarly, the inner sleeve, though having at least eight sides, is not a true octagon shape. This is accomplished in one embodiment by using inner sleeve panels with unequal widths. In another embodiment, the inner sleeve side panels are adhered to the outer sleeve side panels in an off-center manner, thus forming open spaces of unequal sizes between the exterior surfaces of the inner sleeve end panels and the interior surfaces of the outer sleeve corners.

In accordance with further aspects of the invention, the container is for use with an internal bag having a nozzle. In one embodiment, the inner sleeve includes a lower opening formed in one of the inner sleeve end panels, and the outer sleeve includes a lower opening positioned to align with the inner sleeve lower opening. The inner and outer sleeve lower openings are capable of passing an internal bag nozzle therethrough. A lock plate may be used to hold the bag nozzle in position.

In accordance with still other aspects of the invention, various bottom and upper flaps may be used to close out the ends of the container. In one embodiment, the inner sleeve further includes bottom flaps hingedly connected to one or both of its opposed side panels and/or opposed middle end panels. At least one of the opposed bottom flaps are preferably sized to abut one another along their exterior edges as assembled.

In accordance with still further aspects of the invention, a registration slot may be used to align the inner sleeve with the outer sleeve during assembly. After assembly, the container is taken from a flat unitary collapsed state to an open unitary erected state by pushing the distal upright corners of the container toward one another.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

In general, the present invention is a unitary paperboard container formed from two pieces of corrugated material—an inner sleeve and an outer sleeve. As assembled, the inner and outer side walls are laminated, i.e., adhered, to one another, and the container is shipped to a customer in a flat, collapsed, unitary configuration. Once received, the customer can easily store the flat containers in large quantity, without significant cost. To use, the customer opens the container by pushing opposite side corners toward one another. In accordance with aspects of the invention, the container is particularly well suited for use with a conventional fluid bag having a nozzle and fitment. The bag may be placed in the container as described below and filled with a fluid material. As used herein, the term "fluid" refers to a material that behaves in a fluid manner, i.e., a liquid, plasma, dry dispensable material, etc.

Figure 8:
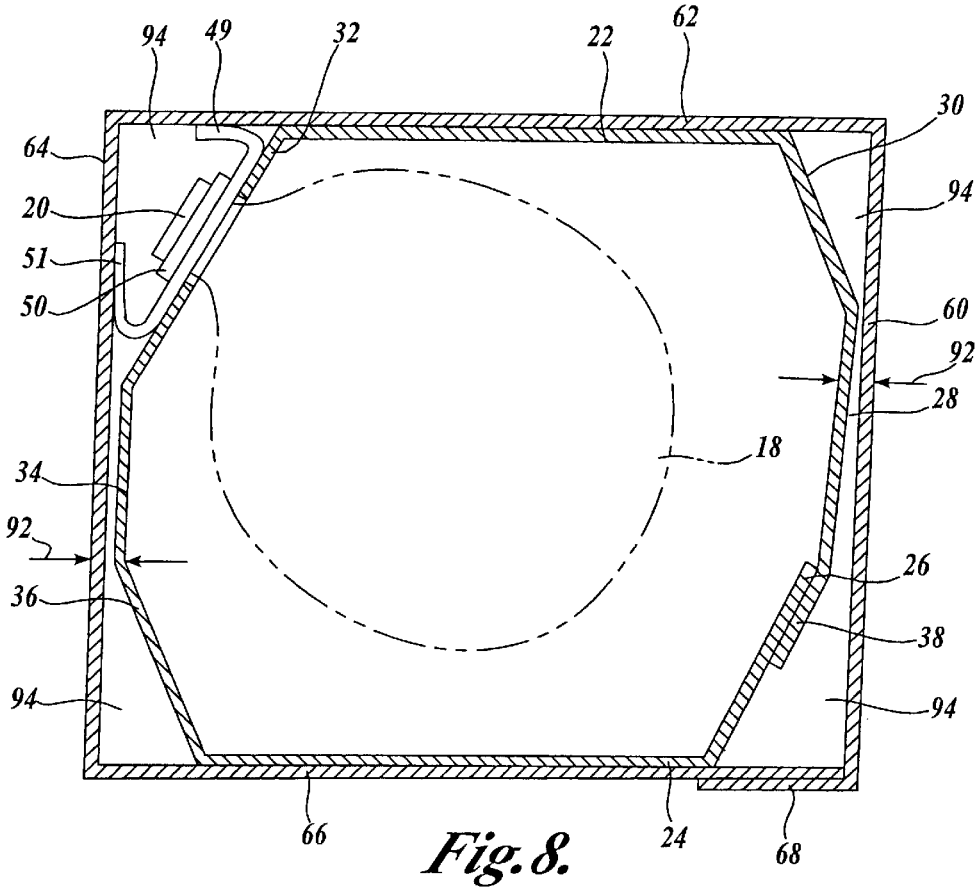
FIG. 8 is a lateral cross-sectional view of the container of FIG. 1, as viewed from a lower position looking upward.
Figure 9:
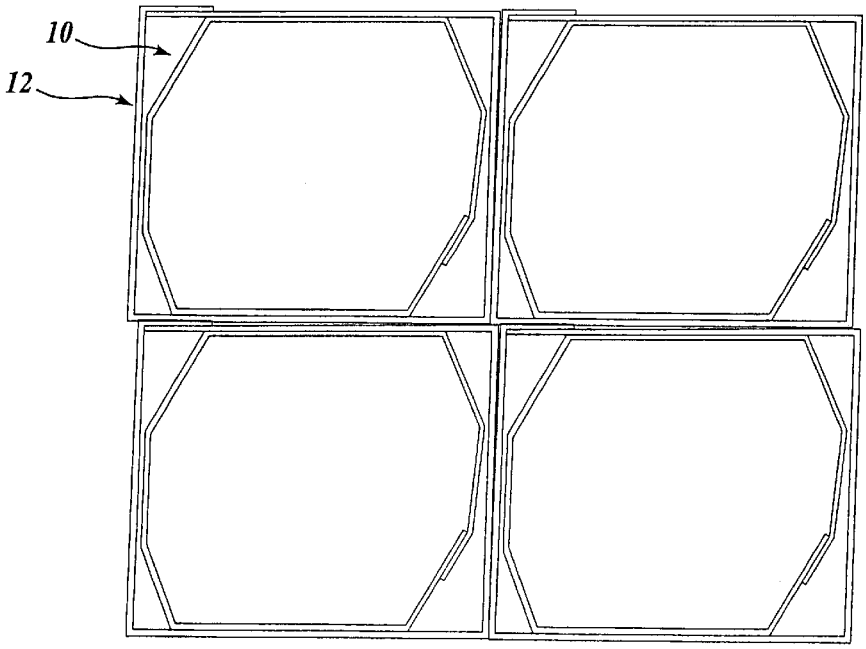
FIG. 9 is a lateral cross-sectional view of four containers as embodied in FIG. 4, as arranged for transport on a U.S. standard-sized pallet, and as viewed from a lower position looking upward.

As will be appreciated upon review of the description herein, various embodiments and aspects of the present invention are described. FIGS. 1 through 6 illustrate two embodiments each having a generally rectangular cross-sectional shape. In one embodiment, each container is capable of holding approximately 55-gallons (or approximately 200 liters) of fluid material and is sized to fit on a standard U.S. 40-inch by 48-inch pallet (or metric 1200 mm by 1000 mm pallet.) FIGS. 7A through 7G illustrate one method of a folding sequence for forming a present invention container. The skewed nature of the present invention container is shown in FIG. 8, using the embodiment of FIG. 1. Similarly, the skewed pallet arrangement is shown in FIG. 9, using the embodiment of FIG. 3.

Figure 10:
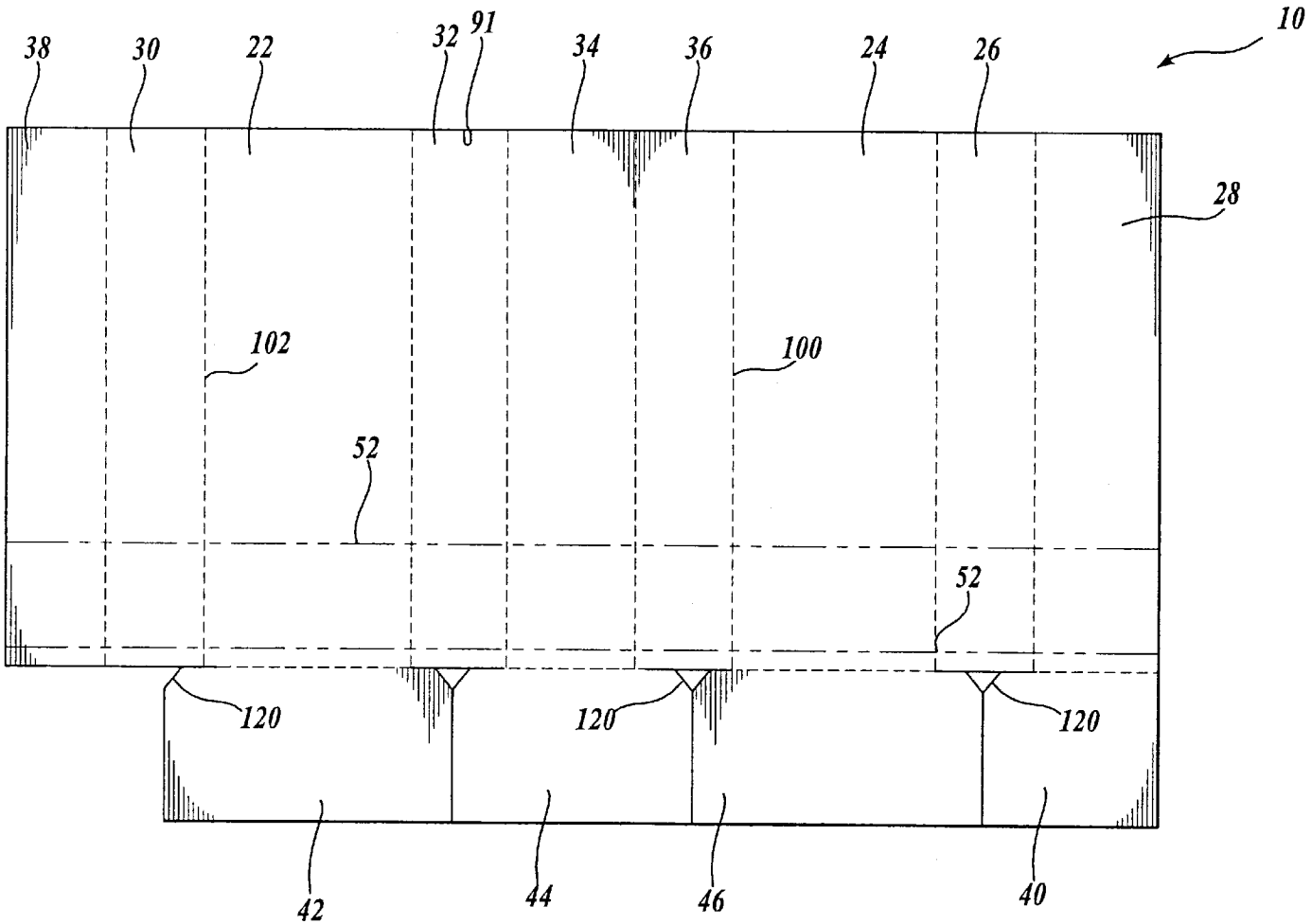
FIG. 10 is an interior plan view of an inner sleeve blank of a third embodiment of a container formed in accordance with the present invention.
Figure 11:
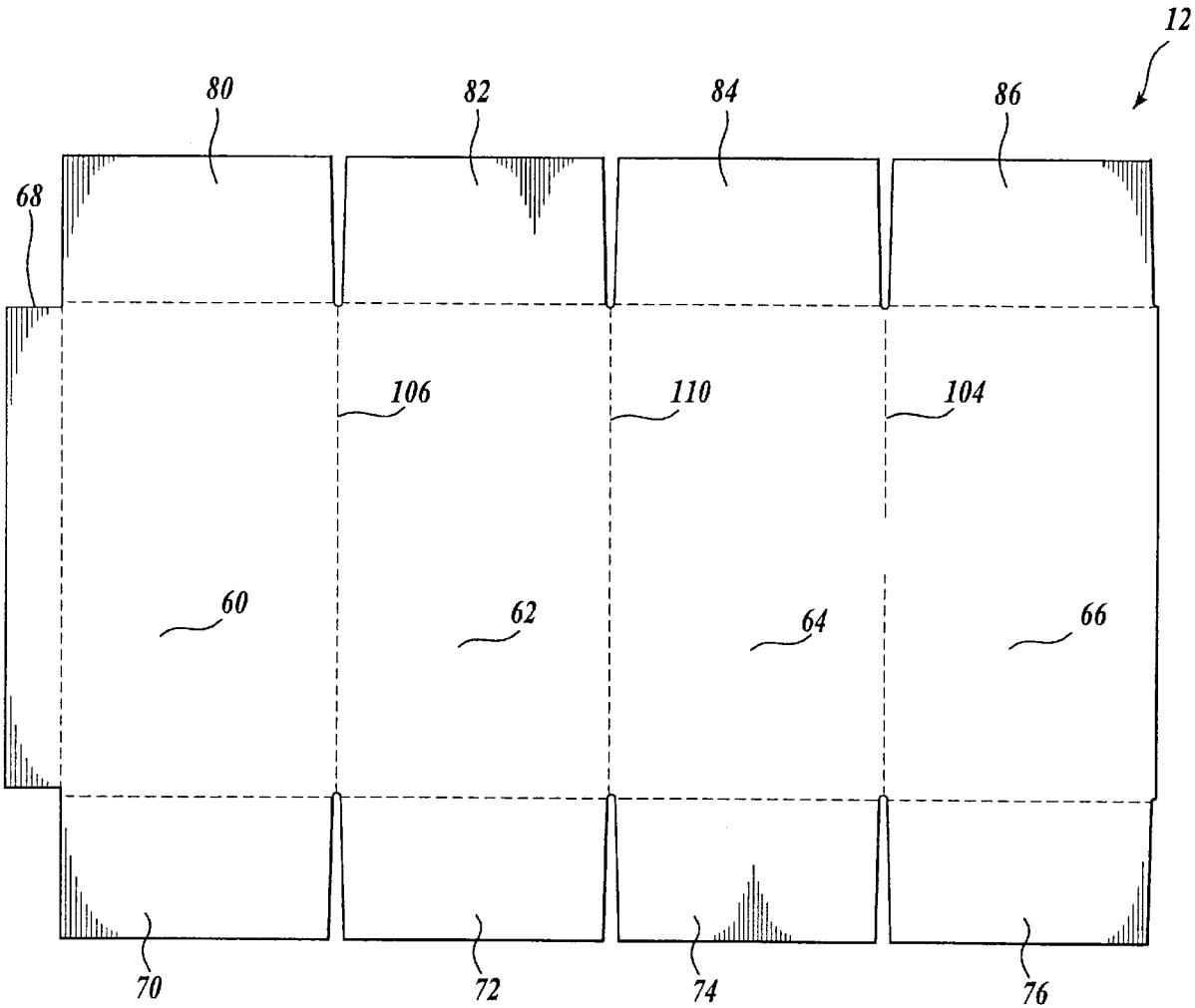
FIG. 11 is an interior plan view of an outer sleeve blank for use with the inner sleeve of FIG. 10.
Figure 12:
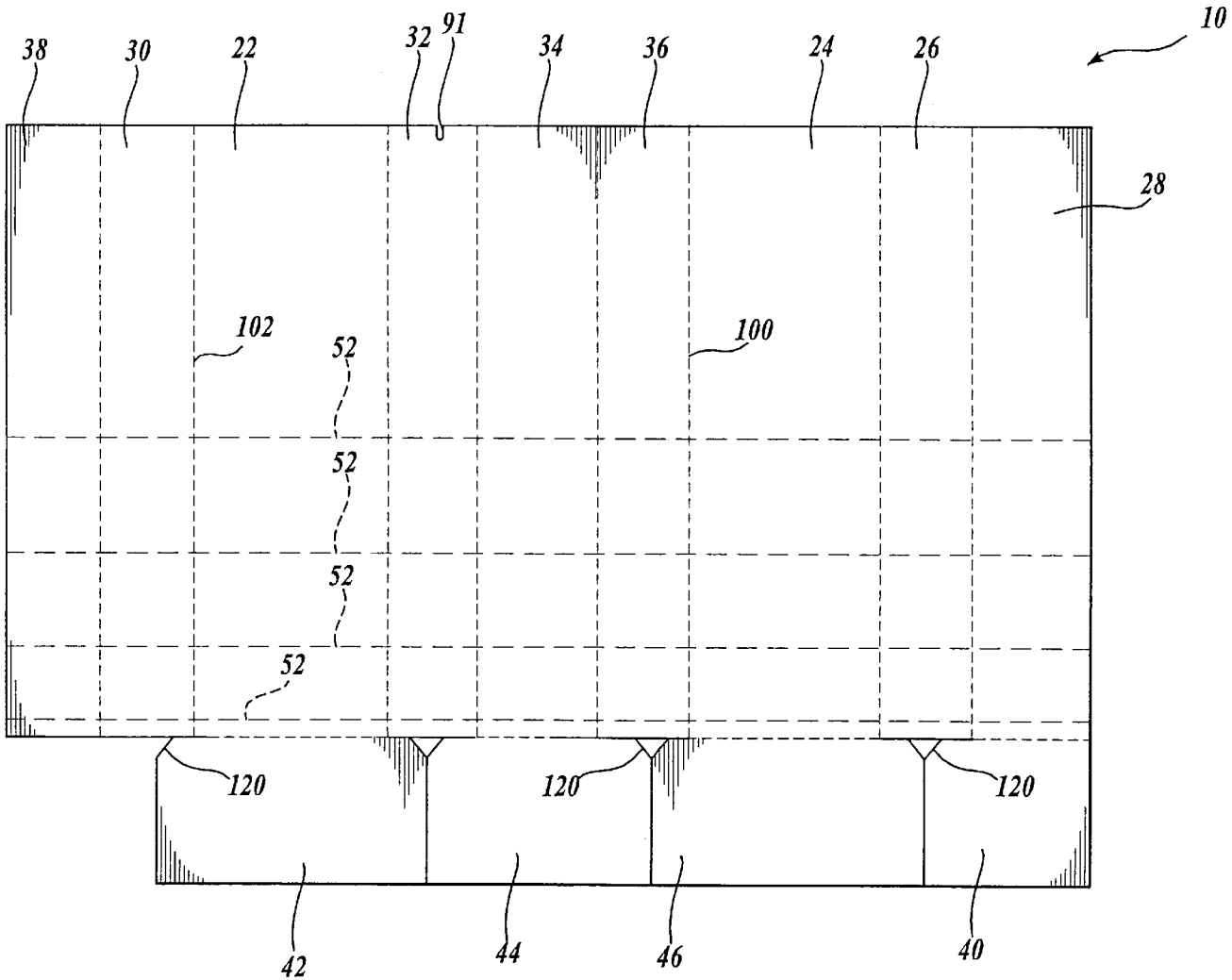
FIG. 12 is an interior plan view of an inner sleeve blank of a fourth embodiment of a container formed in accordance with the present invention.
Figure 13:
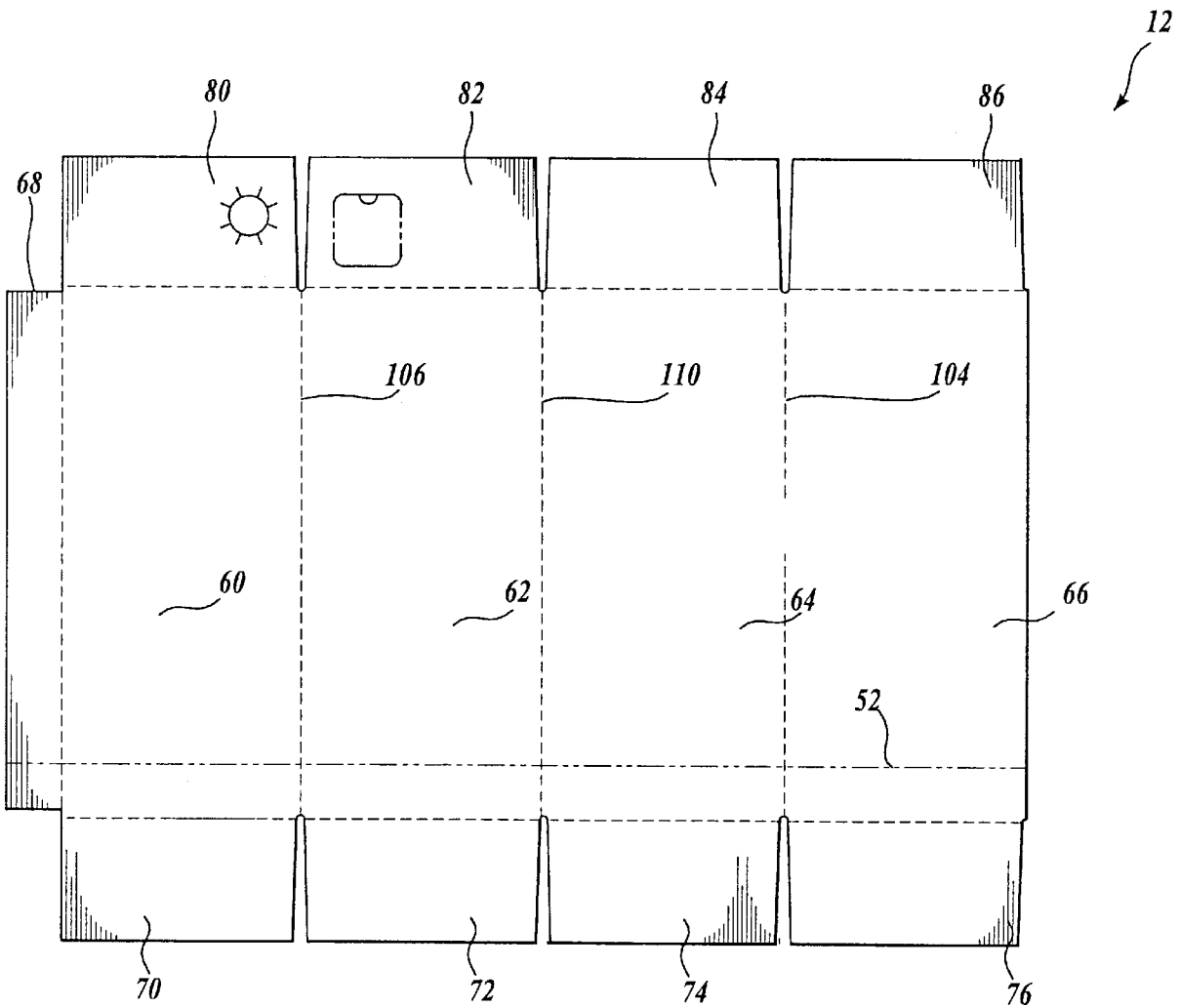
FIG. 13 is an interior plan view of an outer sleeve blank for use with the inner sleeve of FIG. 12.
Figure 14:
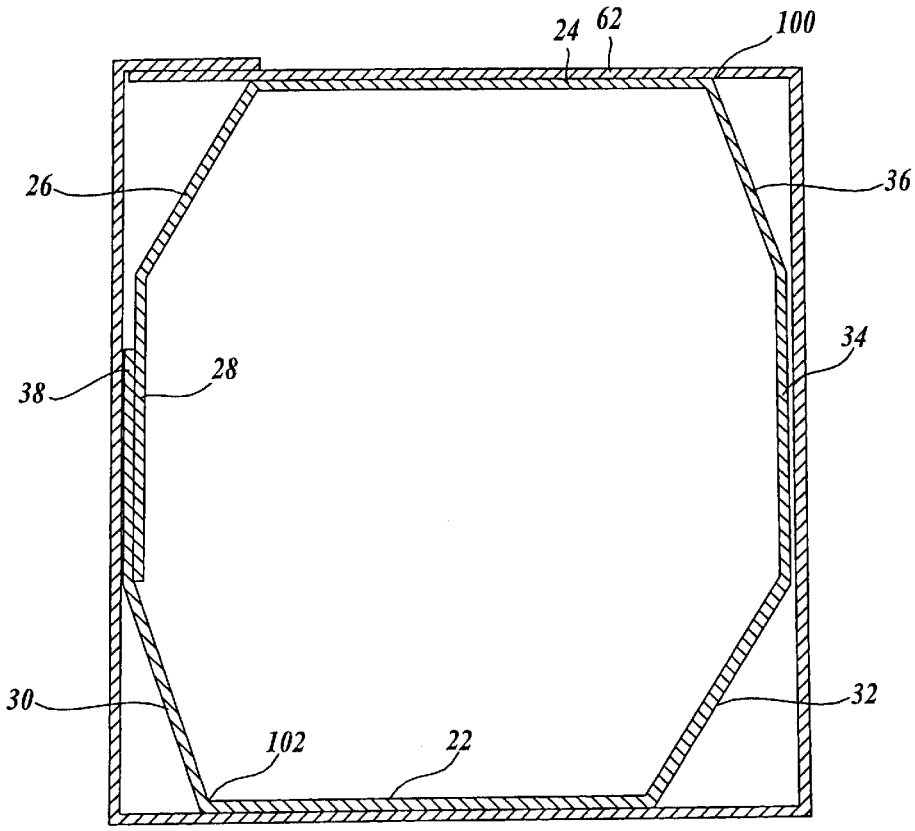
FIG. 14 is a lateral cross-sectional view of the container of FIG. 10, as viewed from a lower position looking upward.
Figure 15:
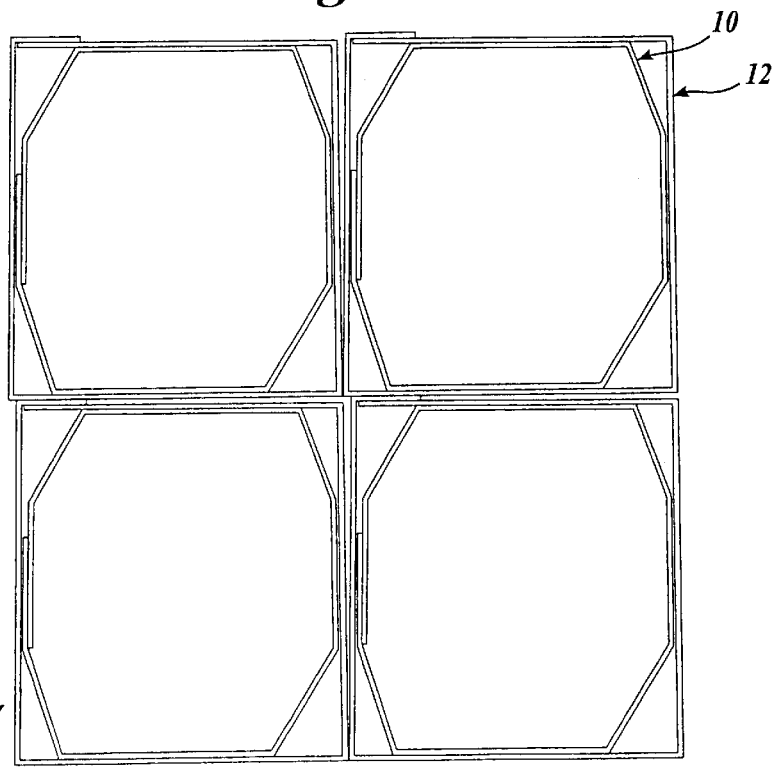
FIG. 15 is a lateral cross-sectional view of four containers as embodied in FIG. 10, as arranged for transport on a conventional drum pallet, and as viewed from a lower position looking upward.

FIGS. 10 through 13 illustrate third and fourth embodiments of the present invention having a generally square cross-sectional shape. These containers may be sized to fit on a standard metal drum pallet (i.e., 43⅜ inch or 1100 mm square pallet.) In the arrangement of FIGS. 10 and 11, the container is capable of holding approximately 200 liters of fluid material. In the arrangement of FIGS. 12 and 13 the container is capable of holding approximately 250 liters of fluid material. The skewed nature of these containers is shown in FIG. 14. Their overall skewed pallet arrangement is shown in FIG. 15.

Figure 1:
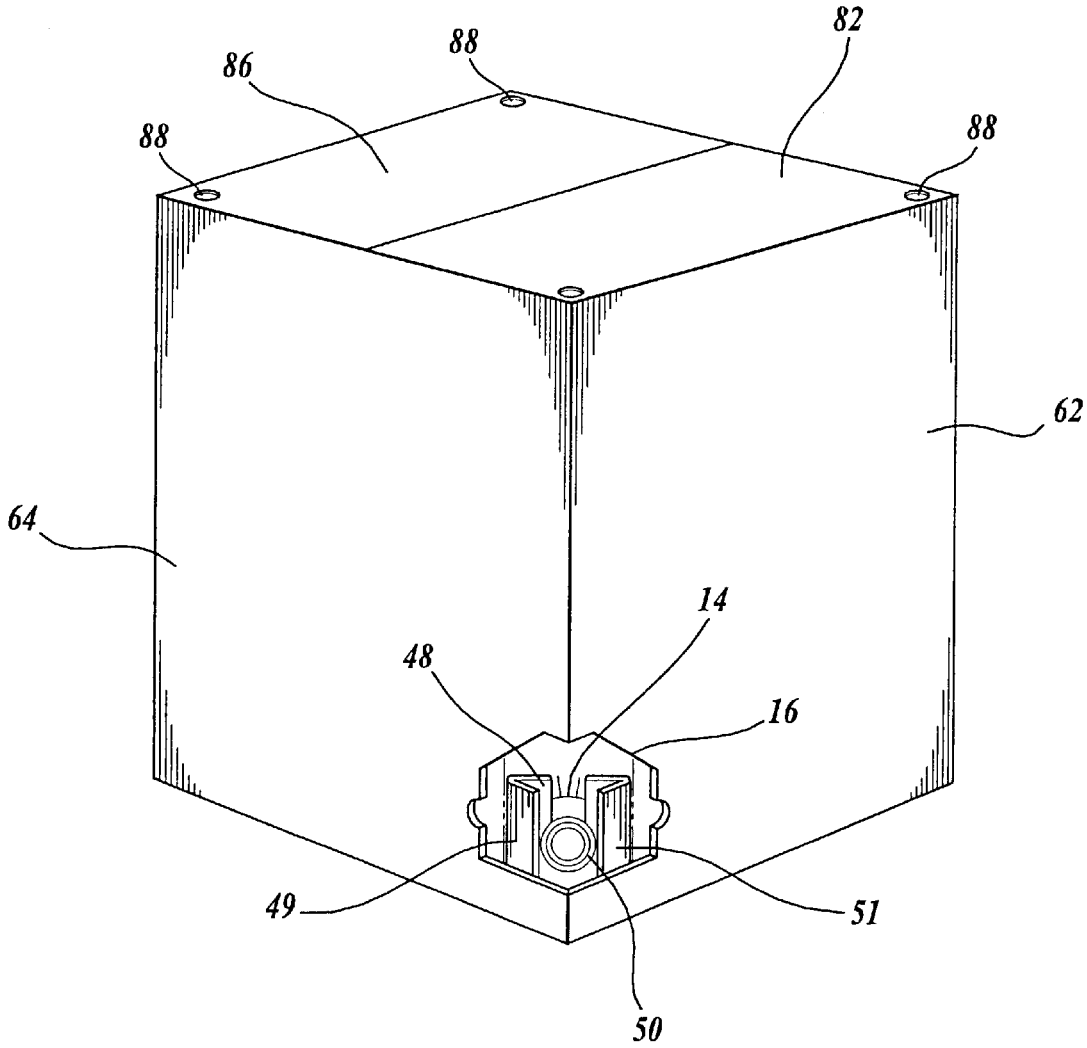
FIG. 1 is a perspective view of a first embodiment of a container formed in accordance with the present invention.
Figure 2:
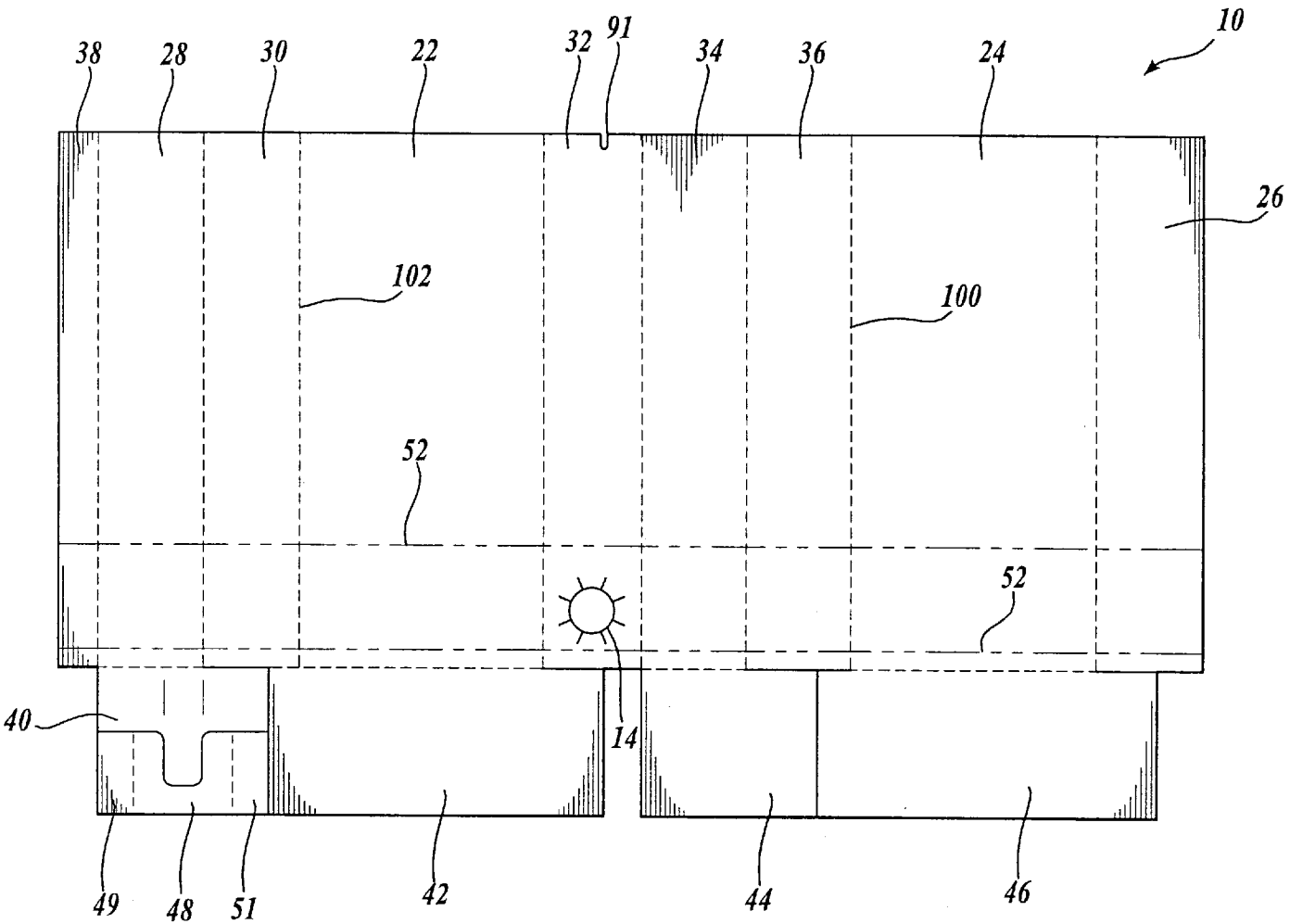
FIG. 2 is an interior plan view of the inner sleeve blank used in the configuration of FIG. 1.
Figure 3:
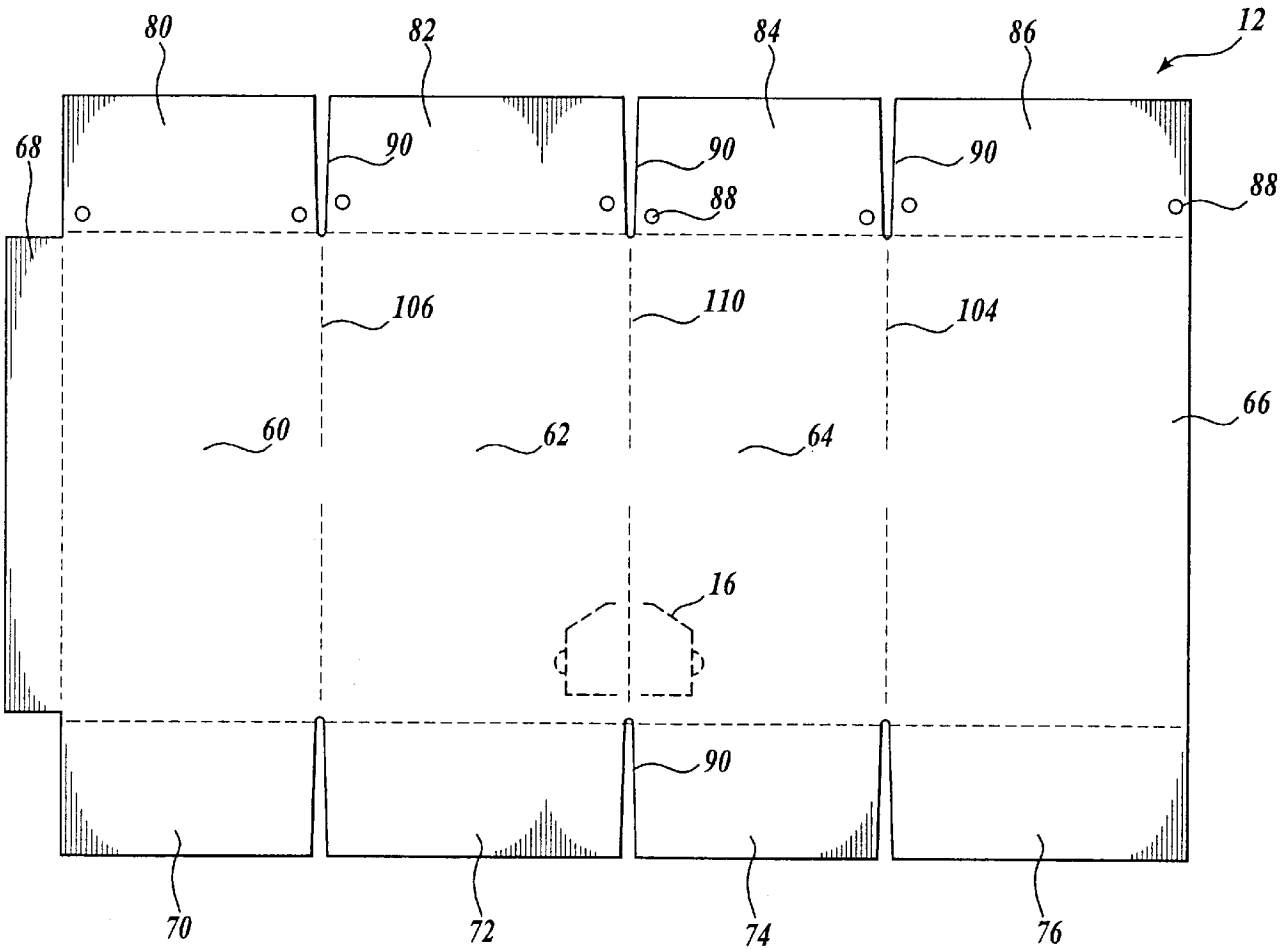
FIG. 3 is an interior plan view of the outer sleeve blank use in the configuration of FIG. 1.

Referring to FIGS. 1, 2, and 3, the container includes an inner sleeve 10 and an outer sleeve 12. As assembled, a lower opening 14 in the inner sleeve 10 aligns with a lower opening 16, also called a "knock out window," in the outer sleeve 12. A conventional internal bag 18 is located within the inner sleeve and oriented such that a bag nozzle 20 extends outward through these inner and outer sleeve openings 14, 16. See FIG. 8. The term "inner container" is used herein to refer to that portion of the container formed by the inner sleeve 10. The term "outer container" is used herein to refer to that portion of the container formed by the outer sleeve 12.

In FIG. 2, the inner sleeve 10 includes a number of side panels distinguished from one another by hinge lines (e.g., 8-point wide crush scores). As shown, this embodiment has a series of eight panels 28, 30, 22, 32, 34, 36, 24, 26 and a glue joint panel 38 hinged to one end of the series. Two of the eight panels 22, 24 are wider than the other panels. These two wider panels 22, 24 form side walls of the inner container, as assembled. The remaining six panels 26, 28, 30, 32, 34, 36 extend between the two wider side panels to form end walls of the inner container. One end wall includes a set of end panels having a first end panel 26, a middle end panel 28, and a second end panel 30. The other end wall also includes a set of end walls also having a first end panel 32, a middle end panel 34, and a second end panel 36. The inner sleeve 10 includes four bottom flaps 40, 42, 44, 46. Two flaps 42, 46 are hingedly connected to the two side panels 22, 24, and two flaps 40, 42 are hingedly connected to the two middle end panels 28, 34, respectively. A U-shaped lock plate 48 is preferably formed in one of the bottom flaps that is connected to either middle end panel. As shown, lock plate 48 is formed in bottom flap 40. The U-shaped lock plate 48 is formed from a number of scores to allow the plate 48 to be easily separated from the flap and used as described below.

As assembled, the two inner sleeve bottom flaps 42, 46 that are hingedly connected to the inner sleeve side panels 22, 24, respectively, are positioned opposite one another. When folded inward, these bottom flaps 42, 46 abut each other along their free outer edge. This results in a completely covered interior end surface with no overlapping joints. This provides even support directly to the bag 18 within the container. The other two inner sleeve bottom flaps 40, 44 are then folded inward to a position exterior to the abutting first two bottom flaps.

Still referring to FIG. 2, the inner sleeve 10 includes the lower opening 14 in one of its end wall panels. In the embodiment shown, the opening 14 is placed along the panel's lower edge and is sized to fit a conventional fluid bag screw fitment 50. Optional sesame tapes 52 may be used along the inner sleeve interior surface both above and below the inner sleeve opening 14 to help maintain the shape of the inner sleeve 10 during use.

In FIG. 3, the outer sleeve 12 includes a series of four panels 60, 62, 64, 66 and a crush glue joint panel 68, each preferably defined from one another by partial or complete crush score lines. Two of the four panels 62, 66 are wider than the other two panels. These two wider panels 62, 66 form side walls of the outer container and are eventually located adjacent to the two opposed inner container side panels 22, 24 when the inner and outer sleeves 10, 12 are joined during assembly. The remaining two outer sleeve panels 60, 64 extend alternatingly between the two side panels 62, 66 to form end walls of the outer container. The outer sleeve 12 includes four bottom flaps 70, 72, 74, 76. Two flaps 72, 76 are hingedly connected to the two outer sleeve side panels 62, 66, and two bottom flaps 70, 74 are hingedly connected to the two outer sleeve end panels 60, 64.

As assembled, the two outer sleeve bottom flaps 70, 74 that are hingedly connected to the outer sleeve end panels 60, 64 are folded toward one another. The two outer sleeve bottom flaps 72, 76 that are hingedly connected to the outer sleeve side panels 62, 66 are also folded toward one another and in doing so are made to abut each other along their free outer edge. This results in a completely covered exterior bottom surface, with no overlapping joints. As a result, the container is evenly supported and displays no tendency to lean to one side or to fall over. The bottom flaps may be sealed using glue or tape. Staples may be used, but are not advised as they could rupture an internal fluid bag 18 or create an unevenness along the bottom surface.

Still referring to FIG. 3, the outer sleeve 12 also includes four upper flaps 80, 82, 84, 86, each upper flap being shaped and sized similar to the outer sleeve bottom flaps. As assembled, the upper flaps 82, 86 that are hingedly connected to the side panels 62, 66 are positioned exterior to the upper flaps 80, 84 that are hingedly connected to the end panels 60, 64. A number of holes, handles, or other openings may be formed in the container to aid in moving the container. In the embodiment shown, the outer sleeve upper flaps 80, 82, 84, 86 have small circular holes 88 over corner free areas 94 (see FIG. 8) that will allow fingers or machine equipment to enter the top of the box and be safely away from the internal bag 18. This is helpful for material handling purposes.

Cuts 90 made to define the upper and bottom flaps of the outer sleeve 12 may be made parallel to one another or tapered as shown in FIG. 3. It is preferred that the outer sleeve flaps are die cut with offset angled tapered slots to make the tote appear to be square as the flaps meet and look to line up evenly. The container, as assembled, however, is slightly off of having exact 90 degree angles at its corners.

The outer sleeve opening 16, or knock out window, is formed by a perforated line that extends across one of the outer sleeve corners. This window is easily removed just prior to use. The window opening 16 is positioned to align with the opening 14 in the inner sleeve 10, as assembled. The size of window should be large enough to secure the fitment 50 while having clear room around it for other valve components to be attached.

In one arrangement, the inner sleeve side panels 22, 24 of FIG. 2 are the same width (e.g., about 16⅜ inches wide), the inner sleeve middle end panels 28, 34 are the same width (e.g., about 7 inches wide), one set of inner sleeve side end panels 30, 36 are the same width to each other and to the middle end panels 28, 34 (e.g., about 7 inches wide), and the opposite inner sleeve side end panels 32, 26 are slightly smaller in width than the inner sleeve middle end panels (e.g., about 6½ inches wide). The outer sleeve side panels 62, 66 are nearly the same width (e.g., one side panel 62 is approximately 23¼ inches wide and the other side panel 66 is about 23 inches wide). The outer sleeve end panels 60, 64 are also nearly the same width (e.g., one end panel 60 is approximately 19⅝ inches wide and the other end panel 64 is about 19¼ inches wide.) These various inequalities between the panels results in the variation of angles, small space size, and free area sizes described above.

Figure 4:
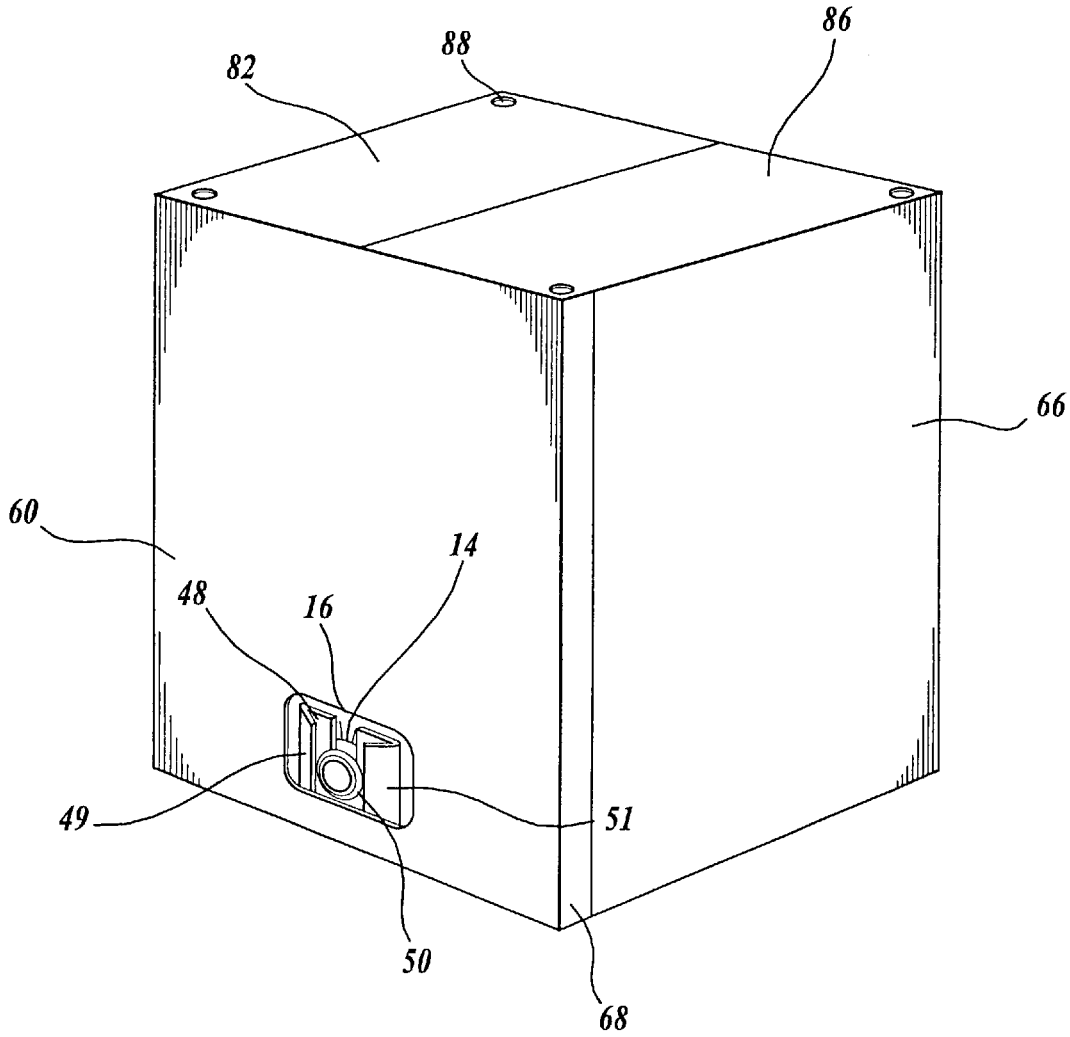
FIG. 4 is a perspective view of a second embodiment of a container formed in accordance with the present invention.
Figure 5:
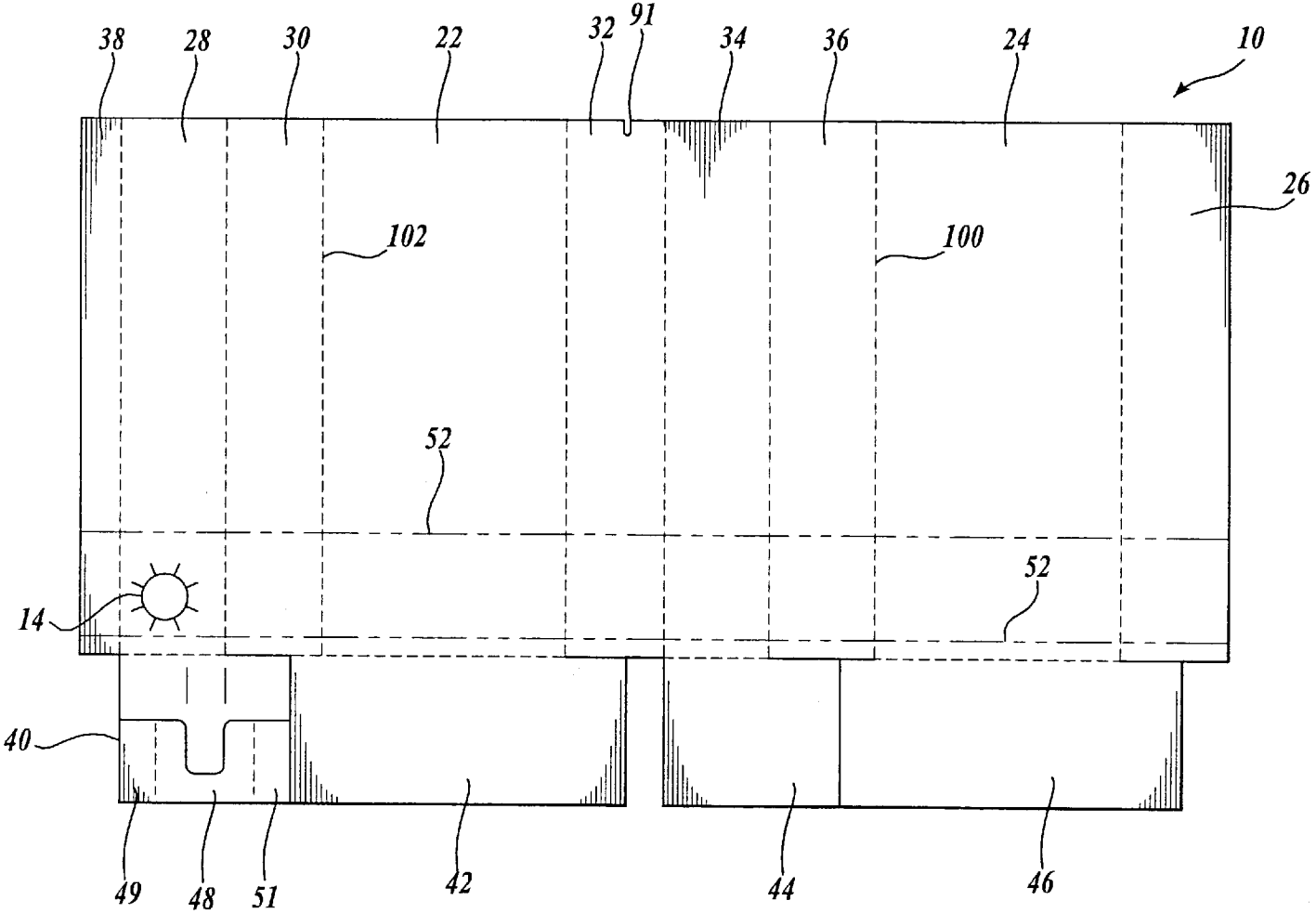
FIG. 5 is an interior plan view of the inner sleeve blank used in the configuration of FIG. 4.
Figure 6:
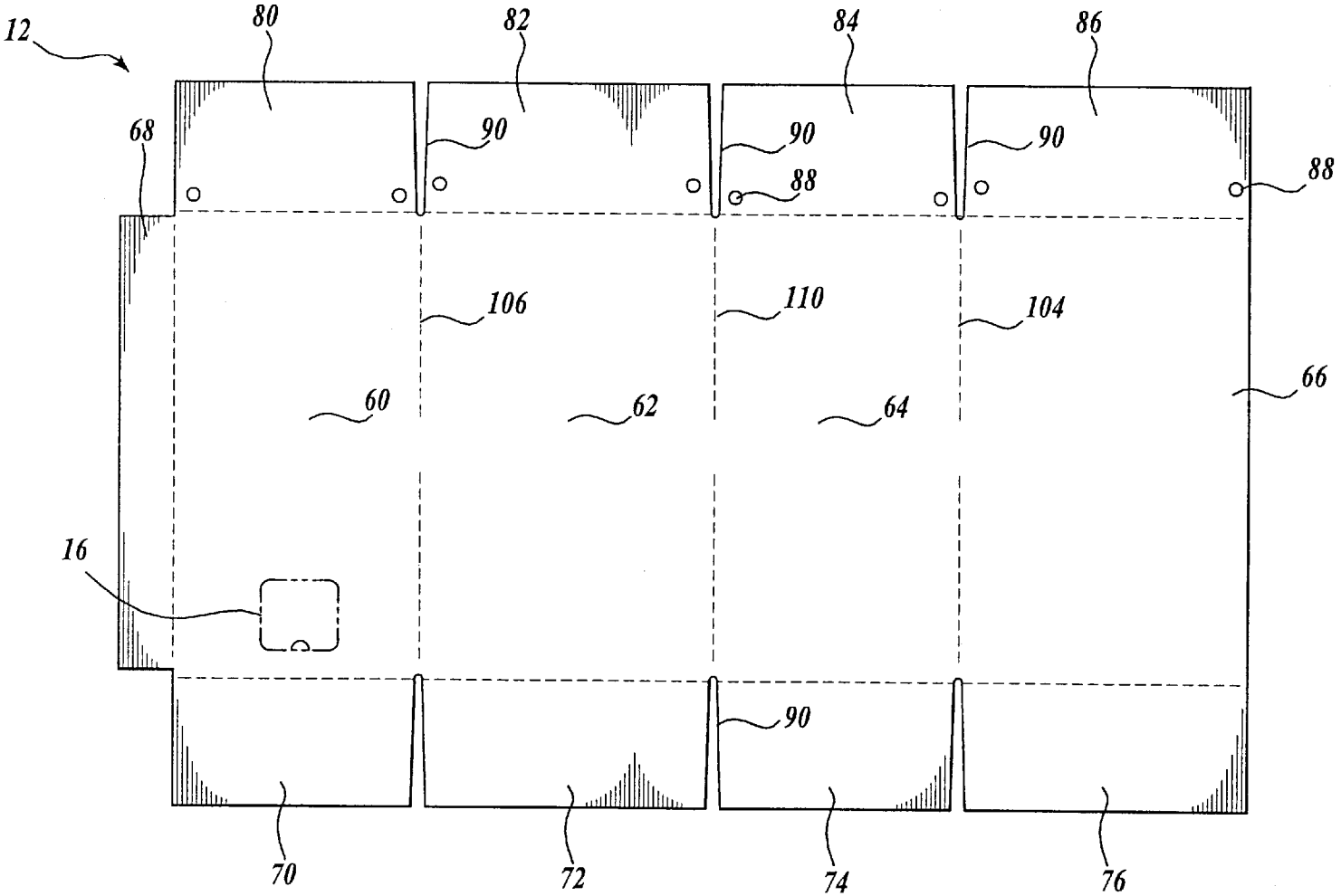
FIG. 6 is an interior plan view of the outer sleeve blank use in the configuration of FIG. 4.

A second embodiment of the present invention is shown in FIGS. 4, 5, and 6. In this embodiment, the inner sleeve opening 14 is formed in an middle end panel, and the corresponding outer sleeve knock out window is formed in an adjacent outer sleeve end wall 60. The components of FIGS. 4, 5, and 6 are similarly numbered as provided in the first embodiment.

In one arrangement, the inner sleeve side panels 22, 24 of FIG. 5 are the same width (e.g., about 16⅜ inches wide), and the inner sleeve middle end panels 28, 34 are the same width (e.g., about 7 inches wide). The end panels 30 and 32 are sized the same width (e.g., about 6½ inches wide), and the remaining end panels 36 and 26 are sized a slightly larger width (e.g., about 7 inches wide). The outer sleeve side panels 62, 66 are nearly the same width (e.g., one side panel 62 is approximately 23¼ inches wide and the other side panel 66 is about 23 inches wide). The outer sleeve end panels 60, 64 are also nearly the same width (e.g., one end panel 60 is approximately 19⅝ inches wide and the other end panel 64 is about 19¼ inches wide.)

Figure 7A:
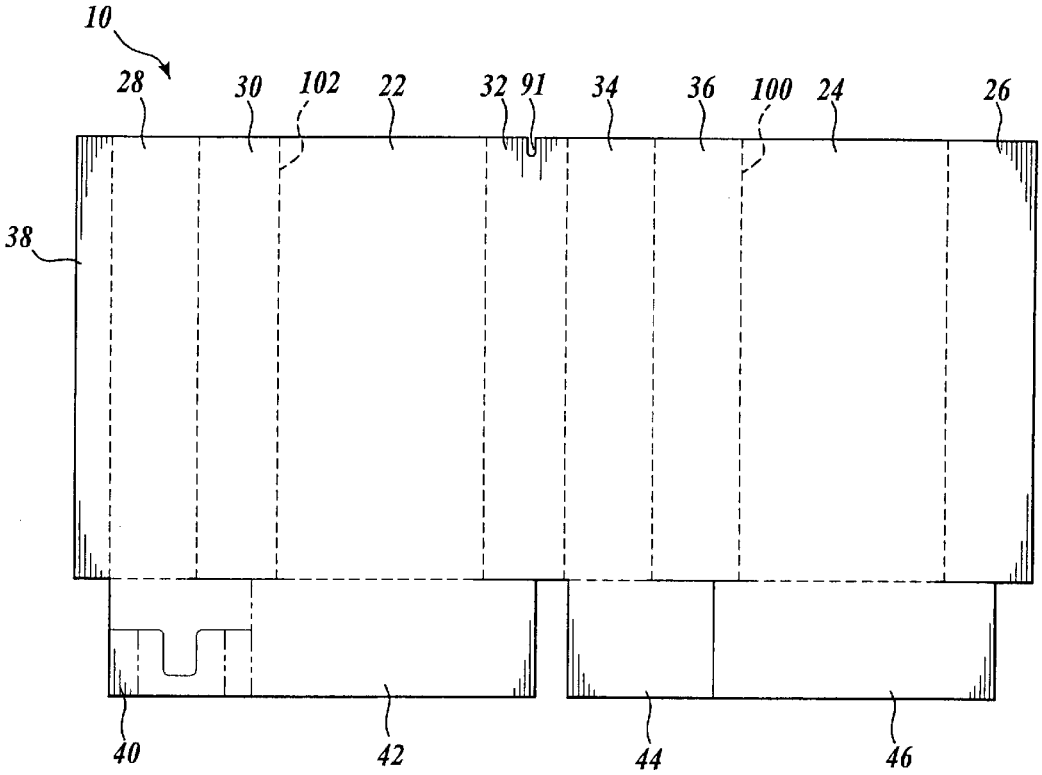
FIGS. 7A, 7B, 7C, 7D, 7E, 7F, and 7G are plan views illustrating one embodiment of a method to assemble the present invention container.
Figure 7B:
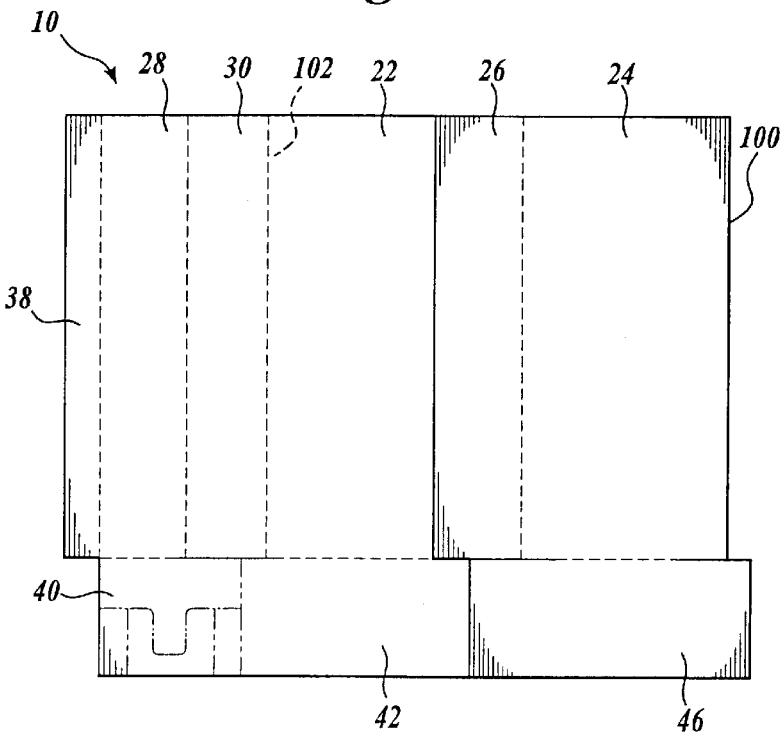
Figure 7C:
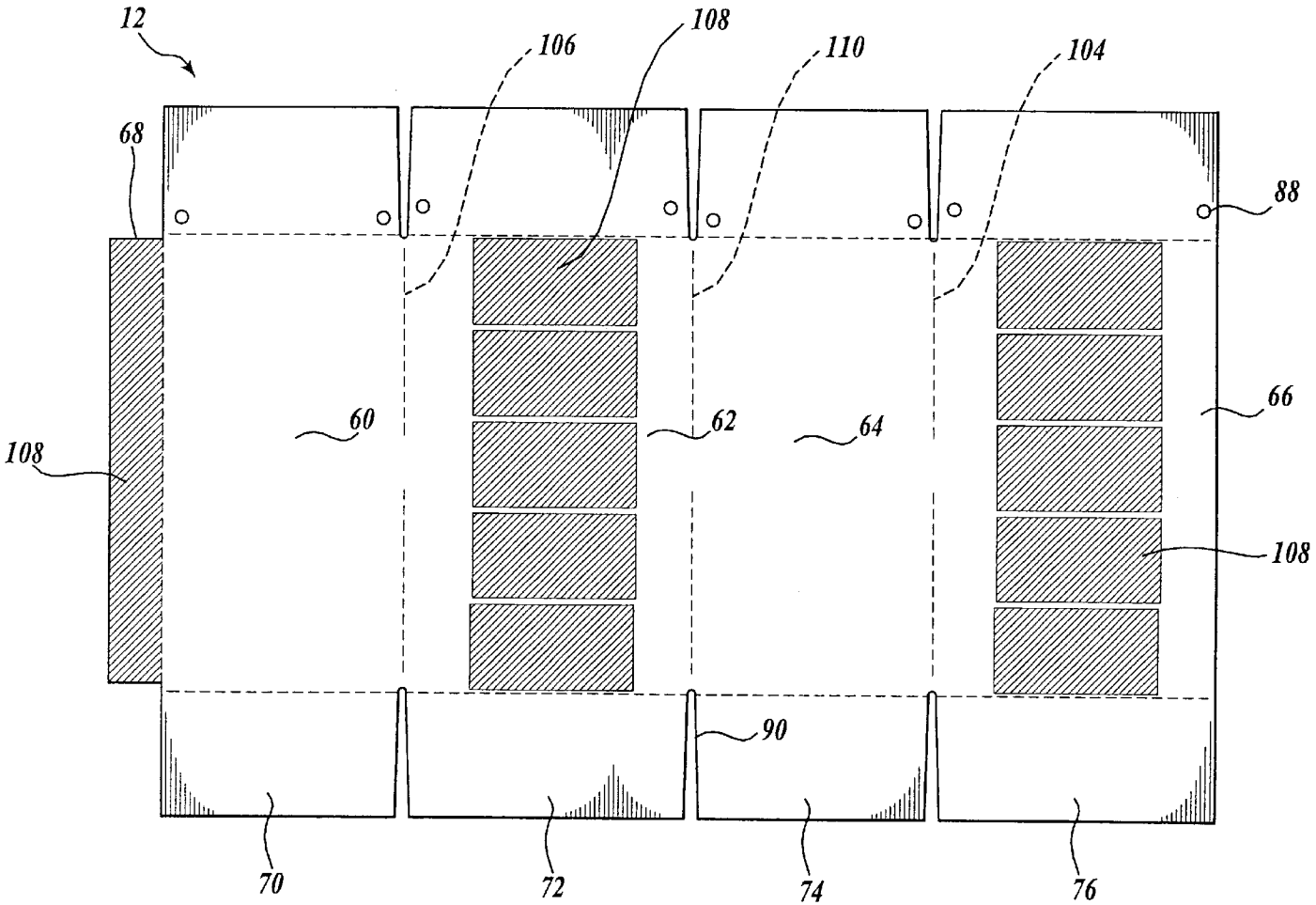

FIGS. 7A through 7G illustrate one method of forming the present invention container. First, the inner and outer sleeve blanks are formed, preferably in a rotary die cutter. The inner and outer sleeves 10, 12 each include two hinge lines that will ultimately form the outermost folds of the collapsed container. In FIG. 7A, the inner sleeve includes a first hinge line 100 and a second hinge line 102. Similarly, FIG. 7C illustrates an outer sleeve first hinge line 104 and a second hinge line 106.

Referring to back FIG. 7A, the inner sleeve 10 is laid laterally with its interior surface facing upward and then folded onto itself along the first hinge line 100, as shown in FIG. 7B. Referring to FIG. 7C, glue lines 108 (or other type of adhesive) are placed at select locations along the interior surface of the outer sleeve side panels 62, 66. In the embodiment shown, five 6½ inch glue heads are used to produce a stacked array of glue strips in a manner centered on each side panel 62, 64. No adhesive is placed on either the inner or outer sleeve end panels.

Figure 7D:
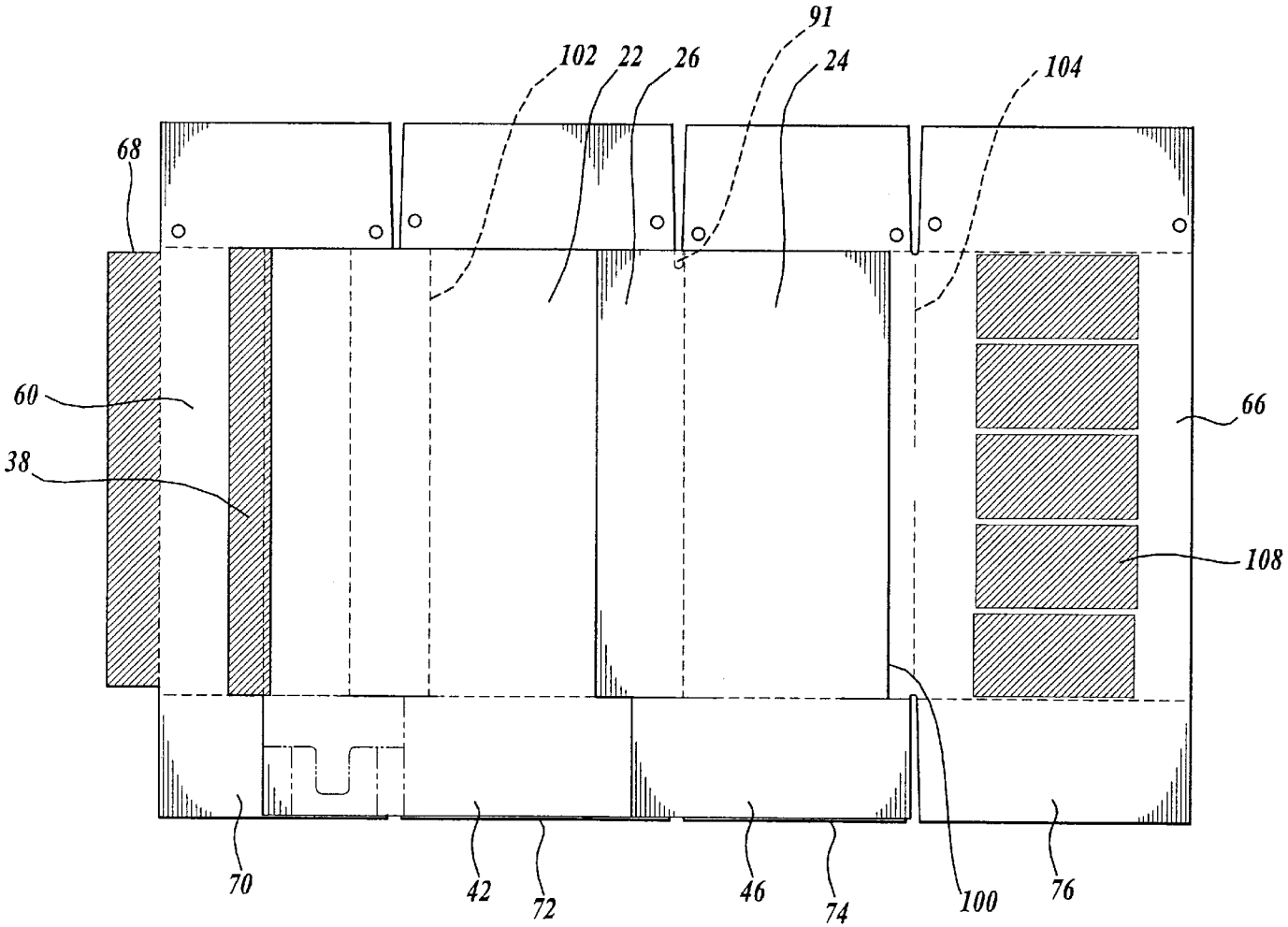

As shown in FIG. 7D, the folded-over inner sleeve 10 shown in FIG. 7B is placed on the outer sleeve 12 with the inner sleeve exterior surface contacting the outer sleeve interior surface. The registration slot 91 is made to align with a designated reference hinge line 110 of the outer sleeve. This results in the exterior surface of the inner sleeve side wall 22 adhering to the glue strips 108 of the outer sleeve side panel 62. Upon close inspection, it may be noted that the glue is not centered relative to the width of the inner sleeve side panel. Instead, it is placed off center so that the assembled inner sleeve will form a eight-sided shape that is similar to a hexagon, but is not, preferably, a true octagon.

Figure 7E:
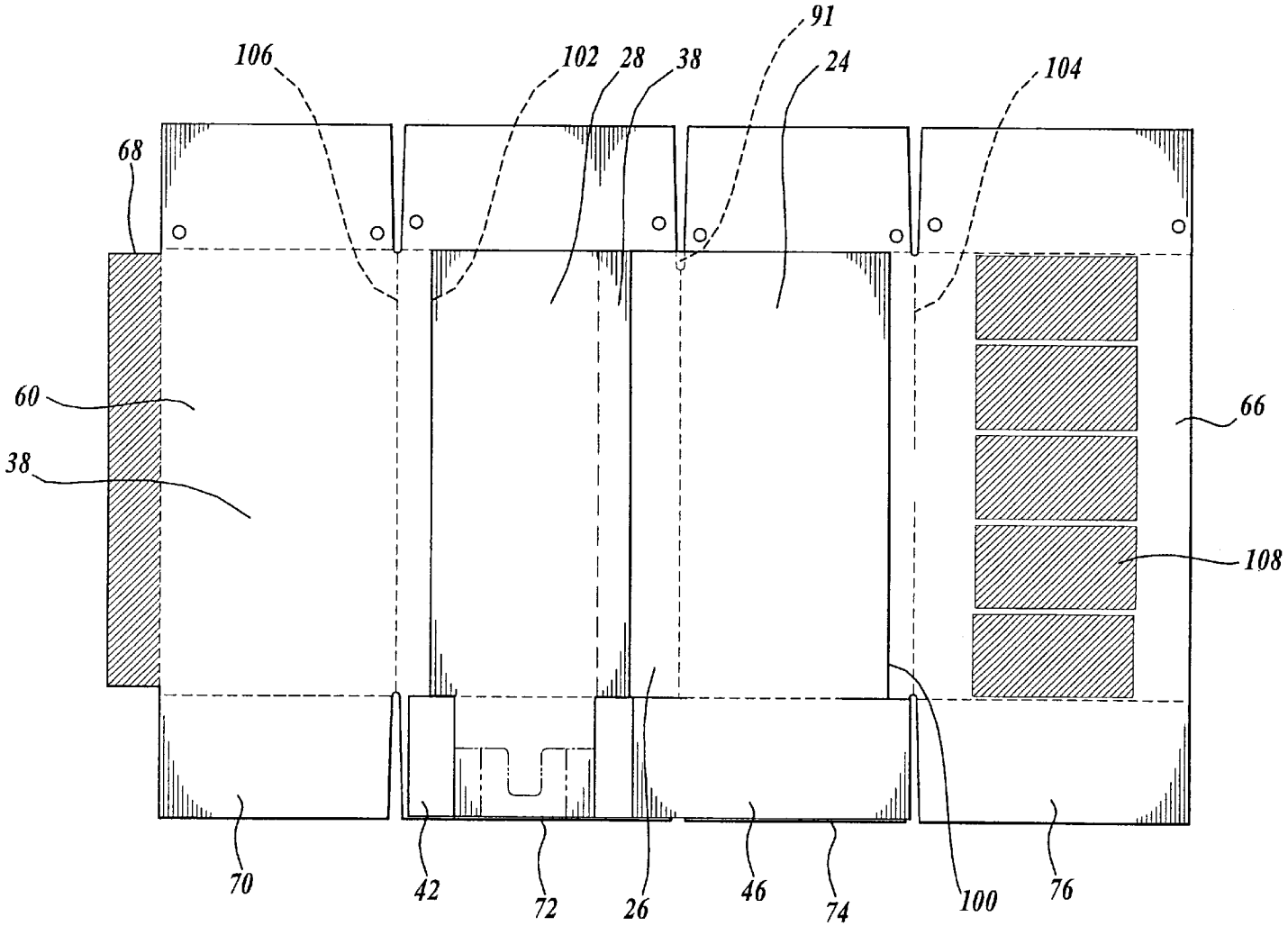
Figure 7F:
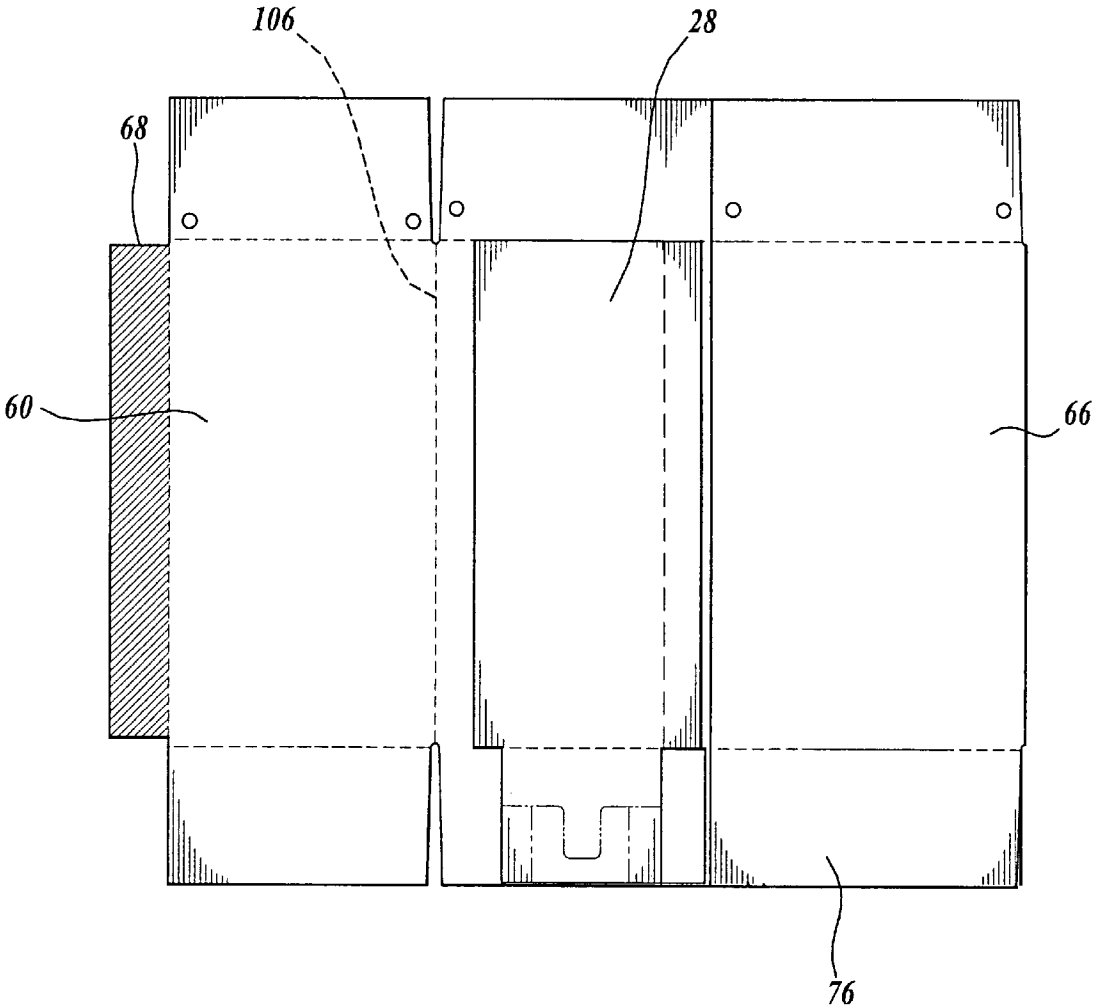
Figure 7G:
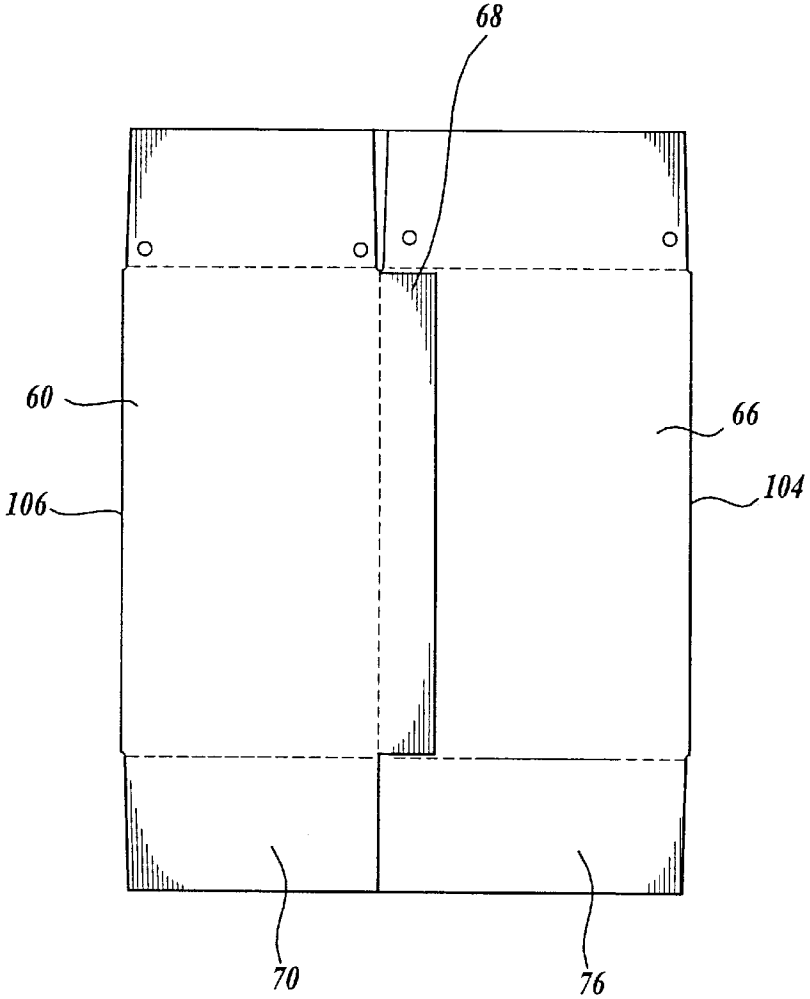

Referring to FIG. 7E, the glue joint 38 of the inner sleeve is folded over and adhered to the exterior surface of the end panel 24. In FIG. 7F, the outer sleeve side panel 66 is folded inward onto the exterior surface of the inner sleeve side panel 24 where the glue lines 108 join the two side panels. Lastly, in FIG. 7G, the outer sleeve end panel 60 is folded inward and the glue joint 68 is adhered to the exterior surface of the outer sleeve side panel 66.

As will be appreciated from the above, the container is initially formed to its flat, unitary, collapsed state. The collapsed container may be shipped to a customer, without taking significant space. Once at the customer, the container may be easily stored until the customer is ready to use it.

Further, it will be appreciated that the formation of the container is such that the resulting erected box has laminated side walls and open end walls. This allows the end walls to move freely relative to one another and to avoid binding in going between collapsed and erected states. Further, the arrangement allows the container to maintain a unitary, or joined, form at all times and to provide extra room for the inner sleeve to expand when filled.

To fill the container, the customer pushes the folded side edges of the collapsed container toward one another (i.e., the exterior surface of hinge lines 14 and 106.) This causes the interior space of the container to open up, with the inner sleeve 10 generally forming an eight-sided shape and the outer sleeve 12 generally forming a four-sided shape.

Turning the box upside down, the customer inserts a bag 18 into the container's open interior space and places the bag's nozzle 20 and fitment 50 through the inner sleeve opening 14. The U-shaped lock plate 48 is placed around the fitment 50, exterior to the inner sleeve 10. As placed in one embodiment, the lock plate 48 is located between the fitment 50 and the exterior surface of the inner sleeve 10. See also the cross-sectional view in FIG. 8. The U-shaped lock plate 48 preferably includes side flaps 49, 51 that are folded inward or outward relative to the plane of the inner sleeve end panel having the opening 14.

As shown, it is preferable to size the inner and outer sleeves 10, 12 so that a small space 92 (e.g., about ⅛ inch to about ½ inch) is available between the inner container end walls and the outer container end walls. This space is useful in providing access space for the customer to set the lock plate 48. Such space may also be provided at the end walls to accommodate any bulging of the inner sleeve when filled. The U-shaped lock plate 48 ensures the continued placement of the fitment 50 through the inner sleeve opening 14.

Upon first opening a collapsed container, the operator may notice a tendency for the inner sleeve 10 to resist folding at two of its end panel crush scores. This tendency is eliminated as the bag 18 is filled with fluid and pushes outward on all inner sleeve panels. Because the inner sleeve end panels are not laminated to the outer sleeve panels, the inner sleeve is free to expand into the available free areas.

The customer continues erecting the container by folding and sealing the bottom flaps 70, 72, 74, 76 to close the bottom of the container. The container is turned right side up and placed on a pallet. The internal bag 18 is filled with material and the container is closed at its upper end. The filled container is now ready to be used or even shipped to a second customer who will dispense and use the fluid product. This is accomplished by removing the knock out window to expose the bag nozzle 20 and fitment 50. An operator may then place a conventional valve spigot on the fitment 50 and proceed with dispensing the bag contents.

Referring to FIG. 8, the selective use of adhesive between side panels results in a number of free areas 94 being formed at the interior container corners between the inner and outer sleeves 10, 12. These free areas 94 are preferably not the same size, although opposed free areas 94 may be similar. Further, in general, the free areas 94 are not formed right triangles with inner angles of 45 degrees. These triangular spaces act as structural columns and are helpful in providing container strength. The spaces also provide room for the inner sleeve to expand into as the inner container is filled. This results in drawing the container side walls inward, further maintaining the container's footprint and overall volume under loads. It is preferable to use as much glue as possible between the inner and outer sleeve side walls in order to maintain the container's unitary configuration.

FIGS. 10 through 13 illustrate third and fourth embodiments of the present invention having a generally square cross-sectional shape. These containers arc sized to fit two-by-two on a standard metal drum pallet (i.e., 43⅜ inch or 1100 mm square pallet.)

In the arrangement of FIGS. 10 and 11, the container is capable of holding approximately 200 liters of fluid material. The glue joint 38 has been formed as a larger non-crushed element that attaches to the middle end panel 28. The glue joint panel 38 is hinged to the second end panel 30, and the middle end panel 28 is hinged to the distal first end panel 26. As assembled, the two pieces 38 and 28 overlap and are adhered to one another. See FIG. 14. The bottom flaps 42, 44, 46, and 40 are provided with notches 120 along their inner corners. These notches help the bottom flaps to align with one another during container assembly. The arrangement of FIGS. 12 and 13 are similar to that of FIGS. 10 and 11 except the container has been increased in height so that it will hold approximately 250 liters of fluid material.

Dimensionally, the inner sleeve side panels 22, 24 of FIGS. 10 and 12 are the same width (e.g., about 14¼ inches wide), the inner sleeve middle end panels 34, 28" are the same width (e.g., about 9 inches wide), the inner sleeve first and second end panels 30, 32, 36, 26 are the same width to one another (e.g., about 6½ inches wide). Referring to FIGS. 11 and 13, the outer sleeve side panels 62, 66 are nearly the same width (e.g., one side panel 62 is approximately 21 inches wide and the other side panel 66 is about 20¾ inches wide). The outer sleeve end panels 60, 64 are also nearly the same width (e.g., one end panel 60 is approximately 21⅛ inches wide and the other end panel 64 is about 20¾ inches wide.)

Referring to FIGS. 14 and 15, even though the inner sleeve panels are fairly consistent with one another, the skewed arrangement of the assembled container is still present due to the various inequalities between the outer sleeve panels and the offset placement of the inner sleeve panels relative to the outer sleeve panels during assembly.

The present invention provides a number of benefits over known metal drums or known paperboard bulk containers. The present invention is preferably made from a percentage of recycled materials and itself is recyclable. The simple removability of the bag makes cleanup easier than the current drum style and the process of collapsing the present invention makes rehandling and recycling more convenient for the customer. In addition, the lamination (adhesion) aspect of the present invention provides additional strategically-placed stacking strength and bulge resistance for the container, while allowing the internally modified semi-octagonal insert to expand into the non-laminated areas, without affecting the outside structure alignment of the container.

While the preferred embodiment of the invention has been illustrated and described, it will be appreciated that various changes can be made therein without departing from the spirit and scope of the invention. For example, the present invention may be made in any number of sizes with capability to handle various volumes, even over 300 gallons. Further, although the present invention is described herein as sized to fit four individual containers on various standard pallets, the container may be made to fit a non-standard size using other dimensions.

By way of another example, the inner sleeve 10 may be made with four, six, eight, ten, or any other numerical combination of panels that allows the container to go from a collapsed to erected form in a unitary fashion and to still maintain areas of expansion between the inner and outer sleeves. Further, the inner and outer sleeve openings may be placed in various locations depending on the method used in dispensing the product. The openings may be on a container top, side, end, or corner depending on the customer's requirements. Alternatingly, the openings may be omitted altogether.

Further, by way of example, the terms "adhesive", "adhering", etc. are meant to refer to any method of connecting two or more panels to one another in a manner that precludes significant movement between the panels. Though, glue or lamination is the preferred method of adhesion, other types of known connective methods may be used, depending on the circumstances of a particular application. In this regard, the adhesion may be made oppositely, that is, between the ends panels of the inner and outer sleeves instead of the side panels. What is important to the present invention is the ability to form a unitary container that is collapsible. This collapsability is aided by the relative movement possible between one set of opposed panels, be them either side panels or end panels.

By way of still another example, the stacking strength of the container may be increased by placing one or more upright tubes (not shown) or the like within the open spaces 94. Similarly, top and/or bottom plates (not shown) may be inserted at the container ends to transmit loads between corners.

The embodiments of the invention in which an exclusive property or privilege is claimed are defined as follows:

1. A bulk container comprising:

(a) an inner sleeve having opposed side panels and two sets of opposed end panels; the inner sleeve including an exterior surface and an interior surface;

(b) an outer sleeve having opposed side panels and opposed end panels; the outer sleeve including an exterior surface and an interior surface;

wherein, as assembled, the inner sleeve is positioned within the outer sleeve; the exterior surface of the inner sleeve side panels or end panels are adhered to the interior surface of the outer sleeve side panels or end panels, respectively; the other of the inner sleeve side panels or end panels are movable relative to the outer sleeve side panels or end panels, respectively;

the assembled container having upright corners formed by the outer sleeve panels, at least two of the outer sleeve upright corners not being true 90 degree angles; and, a registration slot located along an upper edge of the inner sleeve, the registration slot aligning with a reference hinge line in the outer sleeve, wherein, as assembled, the container is capable of assuming a flat unitary collapsed state and an open unitary erected state; the container being initially formed to its flat unitary collapsed state.

2. The container according to claim 1, wherein the outer sleeve panels are provided in various widths in order to form the non-90 degree angles of the outer sleeve upright corners.

3. The container according to claim 2, wherein one outer sleeve side panel is larger than the other outer sleeve side panel and one outer sleeve end panel is larger than the other outer sleeve end panel.

4. The container according to claim 1, wherein the inner and outer sleeves are sized so that they fit in a two column, two row arrangement on a U.S. standard-sized pallet.

5. The container according to claim 1, wherein each set of inner sleeve end panels includes a first end panel, a second end panel, and a middle end panel positioned between the first and second end panels; the inner sleeve side panels are about 16⅜ inches wide, the inner sleeve middle end panels are about 7 inches wide, one set of inner sleeve first and second end panels are about 7 inches wide, the other set of inner sleeve first and second end panels are about 6½ inches wide, one outer sleeve side panel is about 23¼ inches wide and the other side panel is about 23 inches wide, one outer sleeve end panel is about 19⅝ inches wide, and the outer sleeve end panel is about 19¼ inches wide.

6. The container according to claim 1, wherein the inner and outer sleeves are sized so that they fit in a two column, two row arrangement on a European standard-sized pallet.

7. The container according to claim 1, wherein each set of inner sleeve end panels includes a first end panel, a second end panel, and a middle end panel positioned between the first and second end panels; the inner sleeve side panels are about 16⅜ inches wide, the inner sleeve middle end panels are about 7 inches wide, one set of end panels has a first end panel of about 7 inches wide and a second end panel of about 6½ inches wide, the other set of end panels has a first end panel of about 6½ inches wide and a second end panel of about 7 inches wide, one outer sleeve side panel is about 23¼ inches wide, the other outer sleeve side panel is about 23 inches wide, one outer sleeve end panel is about 19⅝ inches wide, and the other outer sleeve end panel is about 19¼ inches wide.

8. The container according to claim 1, wherein the inner and outer sleeves are sized so that they fit in a two column, two row arrangement on a standard-sized drum pallet.

9. The container according to claim 1, wherein each set of inner sleeve end panels includes a first end panel, a second end panel, and a middle end panel positioned between the first and second end panels; the inner sleeve side panels are about 14¼ inches wide, the inner sleeve middle end panels are about 9 inches wide, the inner sleeve first and second end panels are about 6½ inches wide, one outer sleeve side panel is about 21 inches wide, the other outer sleeve side panel is about 20¾ inches wide, one outer sleeve end panel is about 21⅛ inches wide, and the other outer sleeve end panel is about 20¾ inches wide.

10. The container according to claim 1, wherein the inner sleeve is not a true octagon shape.

11. The container according to claim 10, wherein the panels of the inner sleeve are of various widths in order to form the non-octagon inner sleeve shape.

12. The container according to claim 11, wherein each set of inner sleeve end panels includes a first end panel, a second end panel, and a middle end panel positioned between the first and second end panels; each first end panel is of a width less than either of the second or middle end panels.

13. The container according to claim 1, wherein the exterior surface of the inner sleeve side panels are adhered to the interior surface of the outer sleeve side panels in an off-center manner, thereby forming open spaces of unequal sizes between the exterior surfaces of the inner sleeve end panels and the interior surfaces of the outer sleeve upright corners.

14. The container according to claim 1, wherein the container is for use with an internal bag having a nozzle; the inner sleeve including a lower opening formed in one of the inner sleeve end panels, and the outer sleeve including a lower opening that is positioned to align with the inner sleeve lower opening; the inner and outer sleeve lower openings for use in passing an internal bag nozzle therethrough.

15. The container according to claim 14, wherein the outer and inner sleeve panels are sized to allow a space between the inner and outer sleeves prior to the container bag being filled with product to facilitate manipulation of the internal bag.

16. The container according to claim 14, further including a lock plate adapted to hold the bag nozzle at the inner sleeve opening.

17. The container according to claim 16, wherein the lock plate is U-shaped and includes side flaps, the side flaps being provided to wedge the lock plate between the inner and outer sleeves as assembled.

18. The container according to claim 1, wherein the inner sleeve further includes bottom flaps hingedly connected to the inner sleeve side panels and sets of end panels.

19. The container according to claim 1, wherein the inner sleeve further includes at least two bottom flaps hingedly connected to the inner sleeve side panels, the bottom flaps being sized to abut one another along their exterior edges when folded inward during assembly, the abutting bottom flaps being sized and shaped to cover substantially the entire bottom area of the assembled container.

20. The container according to claim 1, wherein the outer sleeve includes bottom flaps hingedly connected to each of the outer sleeve side and end panels.

21. The container according to claim 20, wherein the bottom flaps connected to the outer sleeve side panels are sized to abut one another along their exterior edges when folded inward during assembly.

22. The container according to claim 1, wherein the outer sleeve includes upper flaps hingedly connected to each of the outer sleeve side and end panels.

23. The container according to claim 22, wherein the upper flaps include openings to aid in moving the assembled container.

24. The container according to claim 1, further including sesame tape attached laterally to the interior surfaces of at least one of the inner and outer sleeves to provide circumferential support to the container when filled with product.

25. The container according to claim 1, wherein the container is taken from a flat unitary collapsed state to an open unitary erected state by pushing the distal upright corners of the container toward one another.

* * * * *